United States Patent [19]

Laske

[11] Patent Number: 4,928,217

[45] Date of Patent: May 22, 1990

[54] ADJUSTABLE LAMP

[76] Inventor: Lawrence L. Laske, 153 Mercer St. - 5th Floor, New York, N.Y. 10013

[21] Appl. No.: 308,634

[22] Filed: Feb. 10, 1989

Related U.S. Application Data

[63] Continuation-in-part of Ser. No. 212,175, Jun. 27, 1988, Pat. No. 4,847,740, which is a continuation-in-part of Ser. No. 139,617, Dec. 30, 1987, Pat. No. 4,827,390.

[51] Int. Cl.[5] ..... F21S 1/12

[52] U.S. Cl. ..... 362/427; 362/287; 362/418

[58] Field of Search ..... 362/269, 270, 285, 287, 362/382, 418, 427, 431, 370, 371

[56] References Cited

U.S. PATENT DOCUMENTS

| | | | |
|---|---|---|---|
| 1,781,372 | 11/1930 | Denecke | 362/427 X |
| 2,740,039 | 3/1956 | Phillips | 362/427 X |
| 3,409,767 | 11/1968 | Entwistle | 362/427 X |
| 3,413,459 | 11/1968 | Sonneman | 362/427 X |
| 4,314,319 | 2/1982 | Terry et al. | 32/427 X |
| 4,827,390 | 5/1989 | Laske | 362/427 |
| 4,847,740 | 7/1989 | Laske | 362/427 |

OTHER PUBLICATIONS

Catalogue Recapitulatif, Stilnovo, Milano, Italy, Apr. 1984, particularly at p. 3, Catalog No. 32022, 32012, 12011/2/3.

*Primary Examiner*—Stephen F. Husar
*Attorney, Agent, or Firm*—Thomas W. Speckman; Douglas H. Pauley

[57] ABSTRACT

An adjustable lamp having at least one lamp bar with a lamp attached at one end and an opposite pivot end pivotally attached to a base or pivot leg providing generally vertical pivotal movement of each lamp bar and a support structure supporting each lamp bar at a support point thereon between the lamp end and the pivot end, the support point being vertically placed to provide desired lamp vertical positioning.

6 Claims, 5 Drawing Sheets

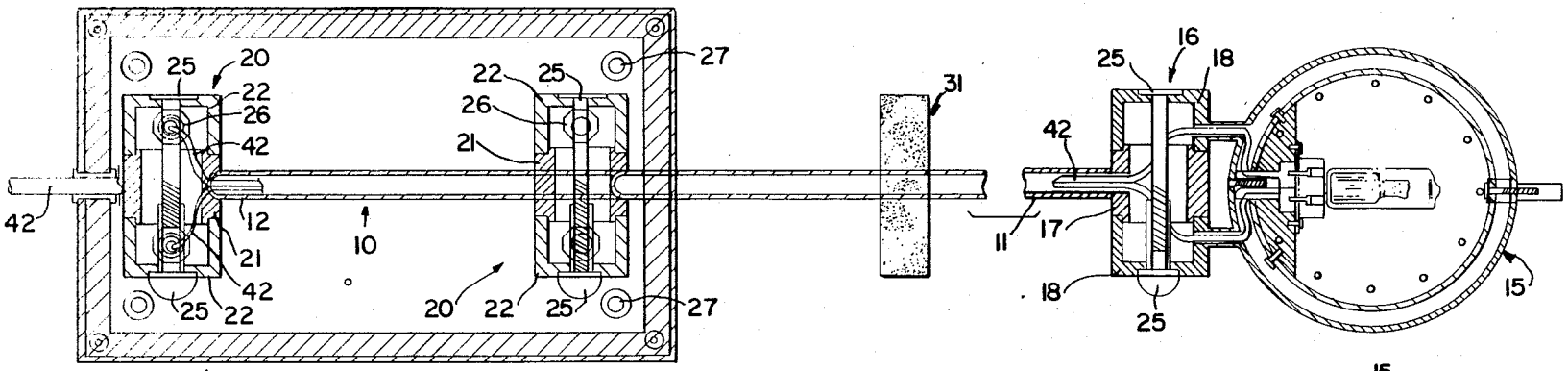
FIG. 12
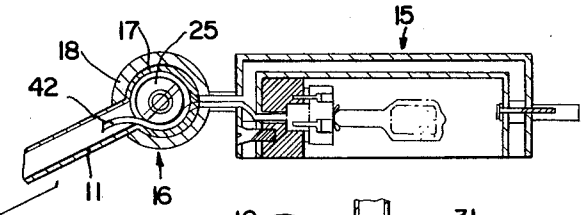
FIG. 11
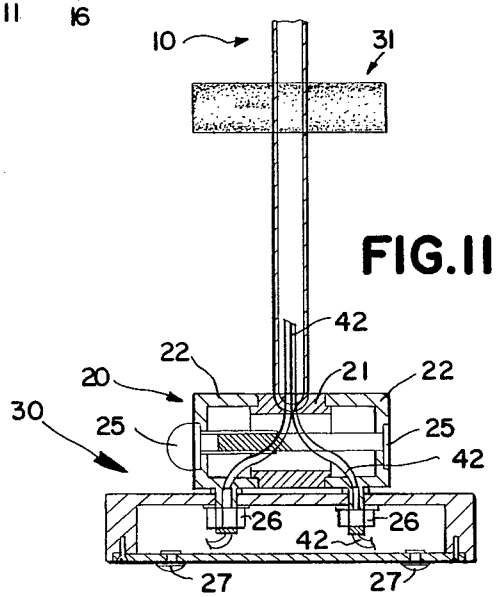
FIG. 10
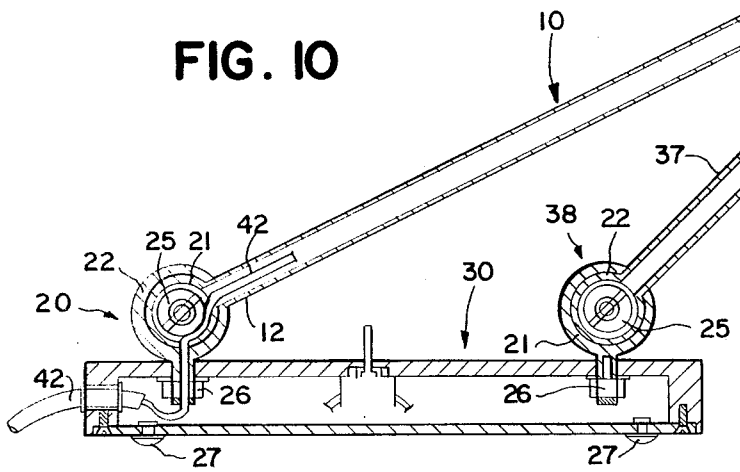

ADJUSTABLE LAMP

CROSS REFERENCE TO RELATED APPLICATION

This application is a continuation-inpart of my copending application, Ser. No. 212,175, filed June 27, 1988, now U.S Pat. No. 4,847,740, which is a continuation-in-part of my earlier application, Ser. No. 139,617, filed December 30, 1987, now U.S. Pat. No. 4,827,390.

BACKGROUND OF THE INVENTION

1. Field of the Invention

This invention relates to a vertically adjustable lamp of the type having a light attached to one end of a lamp bar, movement of the lamp bar and support by an adjustment bar providing desired vertical position for the light. In the adjustable lamp of the present invention, the lamp bar pivots relative to a base at the end opposite to the light providing generally vertical pivotal movement of the lamp bar and a support means is provided supporting the lamp bar at a support point between the pivot end and the end carrying the light to provide desired vertical positioning of the lamp.

2. Description of the Prior Art

A wide variety of adjustable lamps are known which provide a light fixture at the end of a bar-type structure. A large number of such lamps have the pivot point in a central position on the bar structure so as to provide a counterpoise effect as illustrated by U.S. Pat. No. 3,413,459 and in Catalogue Recapitulatif, Stilnovo, Milano, Italy, April 1984, particularly at page 3, Catalog No. 32022, 32012, 12011/2/3. A double counterbalanced arm system is taught by U.S. Pat. No. 3,409,767. It is also known to provide "gooseneck"lamp arms which are constructed of flexible material and may be bent to retain their shape at the desired positioning. Lamp arms which are rotatable about a pivot point and require adjustment of the pivot position by loosening or tightening the pivot mechanism are also known to the art.

Phillips, U.S. Pat. No. 2,740,039 teaches a vertically and angularly adjustable lamp of the electric portable desk type for use in offices and the like. The lamp supporting structure has a base and a separate and distinct vertically disposed rotatable post. The rotatable post is mounted on the base. A tubular bearing is pivotally mounted at the top of the post and an elongated supporting arm is slidably carried by the pivotally mounted bearing. The supporting arm has a lamp affixed at one end of the supporting arm. The supporting arm has transverse grooves which mate with a pin and allow the supporting arm to slide along its longitudinal axis with respect to the pivotally mounted bearing.

Denecke, U.S. Pat. No. 1,781,372 teaches a light support having a base, an upright, an extension arm, and a light suspended from the outer end of the arm. Terry et al., U.S. Pat. No. 4,314,319 teaches an adjustable lamp having a main arm pivotally attached to a base at one end and carrying a lamp housing at the other end. A spring urged link having adjustable frictional resistance to sliding is connected to the main arm at an upper end and to the base at the opposite end of the main arm.

SUMMARY OF THE INVENTION

The present invention is directed to a vertically adjustable lamp with a light attached to one end of a lamp bar and the opposite end of the lamp bar attached to a freely movable or fixed pivot assembly attached to a lamp base providing generally vertical pivotal movement of the lamp bar. A support means supports the lamp bar at a support point on the lamp bar between the lamp end and the pivot end and vertically places the support Point of the lamp bar to provide the desired lamp vertical position. In one embodiment, the lamp bar pivot assembly is fixedly attached to the base, while in another embodiment, the lamp bar pivot assembly is attached to the base by vertically adjustable attachment. In either embodiment, the lamp bar freely pivots by a generally vertical pivotal movement of the lamp bar about the pivot assembly at one end of the lamp bar and is supported in desired vertical position by a support means supporting the lamp bar at a support point spaced between the lamp end and the pivot end of the lamp bar to maintain the lamp at a desired vertical position.

In one embodiment, the lamp bar support is adjustably engageable in a plurality of generally vertically arranged holding mechanisms on a generally vertical portion of the base. The holding mechanisms may comprise a series of holes, notches, or any other structure to hold the lamp bar support.

In another embodiment, the lamp bar support may be in the form of an upstanding adjustment bar arm pivotally attached to and in a fixed position with respect to the base at a lower end of the adjustment bar. The other end of the adjustment bar contacting the lamp bar at its intermediate support point. Pivotal movement of the adjustment bar raises and lowers the lamp bar which pivots about the lamp bar pivot means at the end of the lamp bar attached to the base structure.

In another embodiment, at least one upstanding adjustment bar has at least one cross section at the upper end, each forming a T-bar, and a peg end at the lower end. The peg end of each adjustment bar is mateable with at least one hole in the base. In a mated position, the at least one upstanding adjustment bar supports the lamp bar.

In another embodiment, the lamp bar support may be furnished by a fixed upstanding support bar attached to the base at its lower end and providing support to the support point of the lamp bar at its other end with generally vertical pivotal adjustment of the lamp bar being achieved by vertical movement of the lamp bar pivot assembly with respect to the base. Vertical adjustment of the lamp bar pivot assembly vertical adjustment may be achieved in generally the same fashions as above described for vertical adjustment of the support for the lamp bar.

BRIEF DESCRIPTION OF THE DRAWING

The above objects and advantages of this invention are described in preferred embodiments and shown in the drawing wherein:

FIG. 10 shows a cross-sectional front view of an adjustable lamp as shown in FIG. 9;

FIG. 11 shows a cross-sectional side view of an adjustable lamp as shown in FIG. 10;

FIG. 12 shows a cross-sectional top view of an adjustable lamp as shown in FIG. 10;

DESCRIPTION OF PREFERRED EMBODIMENTS

Figure 1:
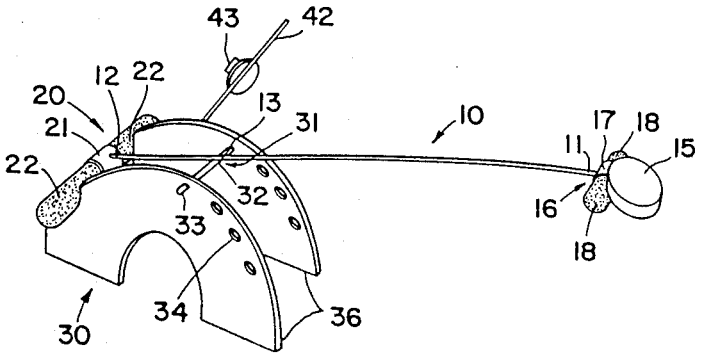
FIG. 1 is a perspective view of one embodiment of an adjustable lamp according to this invention having a lamp bar pivot fixedly attached to the base and generally vertically adjustable support mating with generally vertical arches of the base.

FIG. 1 shows one embodiment of an adjustable lamp of this invention having base 30 comprised of two generally vertical uprights 36. Lamp bar 10 has lamp end 11 and pivot end 12 with support point 13 therebetween. Lamp bar 10 may be constructed of any generally rigid material such as metal such as brass or steel, or of a synthetic polymer material such as nylon or fiberglass. Lamp bar 10 may preferably be tubular-shaped, round or polygonal, or may be of a channel or angular shape to provide concealed carrying of electrical wires for its length to provide electricity to the light at its lamp end. Any suitable illuminating lamp 15 may be mounted on lamp end 11 of lamp bar 10. Illuminating lamp 15 may be of any suitable illuminating type known to the art, such as a high intensity lamp. Illuminating lamp 15 may be fixedly attached to lamp end 11 of lamp bar 10 or may preferably be attached by lamp pivot and/or swivel means 16 providing a fixed portion 17 and a pivot or swivel portion 18 for fixed attachment to illuminating lamp 15 by a wide variety of means well known to the art.

Figure 3:
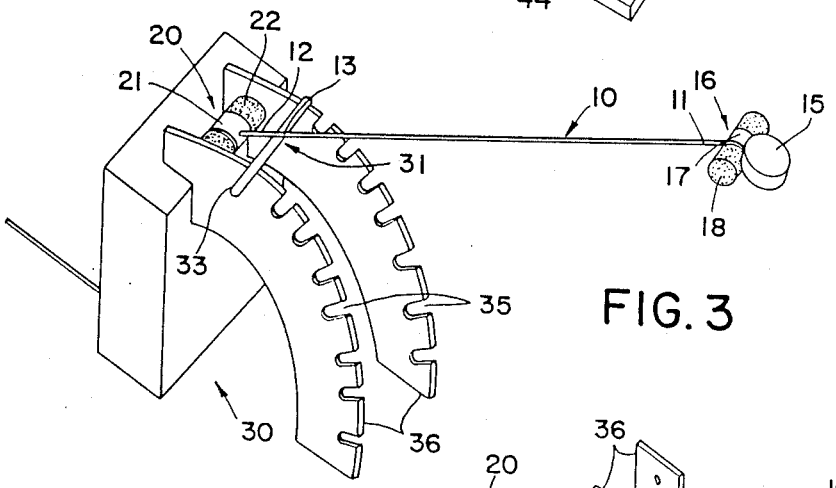
FIG. 3 is a perspective view of another embodiment of this invention having a generally vertical base portion and a lamp bar pivot fixedly attached to the base portion and generally vertical adjustable support mating with generally vertical partial arcuate sections of the base.

Lamp bar pivot means 20 has central pivot portion 21 attached to pivot end 12 of lamp bar 10 and is freely pivotable about end fixed portions 22 which are fixed to vertical uprights 36 of base 30. In another embodiment pivot end 12 may be split into two lateral portions attached to spaced pivot portions which are freely pivotable about a central fixed portion fixed to the base. Support means in this embodiment comprise adjustment bar 31 having support portion 32 for support of lamp bar 10 at support point 13 and positioning portions 33 for vertical adjustment in base holding means, shown in FIG. 1 as holes 34. Adjustment bar 31 may be provided as any sufficiently rigid material such as metals or synthetic polymers, and may be of any suitable shape to mate with a generally vertically arranged plurality of base holding means which may be in the form of notches 35 as shown in FIG. 3, holes 34 as shown in FIG. 1, or any other type of generally vertically arranged holding means. It is thus seen that as shown in FIG. 1, illuminating lamp 15 is in its highest vertically adjustable position and may be lowered by placement of adjustment bar 31 in any of the lower generally vertically arranged holes 34. Illuminating lamp 15 may be pivoted to an out-of-the way position simply by lifting lamp end 11 of lamp bar 10 thereby pivoting central pivot portion 21 of lamp bar pivot means 20 to a desired upright or laid back position against a stop means acting upon central pivot portion 21 with return of illuminating lamp 15 to its identical illuminating position by pivoting forwardly so that support point 13 of lamp bar 10 against rests upon adjustment bar 31.

Electrical wiring of the adjustable lamp of this invention is not a part of this invention and may be achieved by any means known to the art, such as by electric supply cord 42 which may have an in-line switch 43 and may feed electricity to illuminating lamp 15 through central pivot portion 21 of lamp bar pivot means 20 and lamp bar 10 as shown in FIGS. 10–12 and FIGS. 14–16 or by other means well known to the art.

Figure 2:
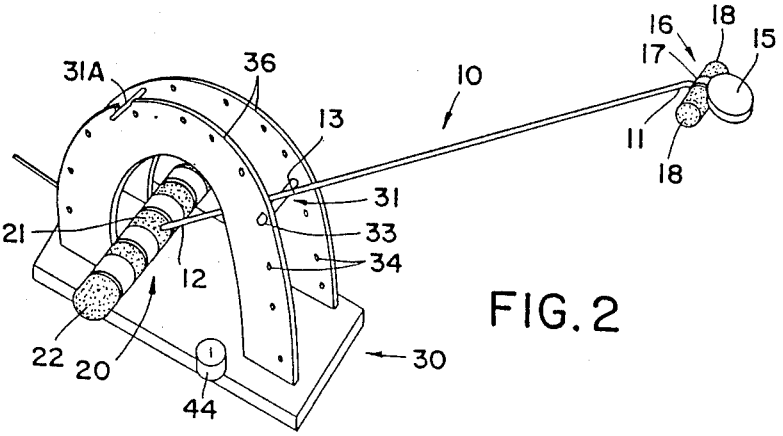
FIG. 2 is a perspective view of another embodiment of an adjustable lamp having a lamp bar pivot fixedly attached to a flat base portion and a generally vertically adjustable support mating with generally vertical arches of the base.

FIG. 2 shows another embodiment of the adjustable lamp of this invention wherein base 30 has a flat portion with two generally vertical upstanding arch portions 36. Lamp bar pivot means 20 is fixedly attached to the flat base portion and adjustment bar 31 placed in desired vertically arranged holes 34 to hold lamp bar 10 in the desired vertical position. The embodiment shown in FIG. 2 is particularly suited for placement of an adjustment bar 31A in second set of holes 34 in vertical uprights 36 to provide a fixed second position or laid back position for lamp bar 10. Also in the embodiment shown in FIG. 2, electrical switch 44 is shown on the flat plate portion of base 30. In other manners, the embodiment of the adjustable lamp shown in FIG. 2 operates in the same fashion as described with respect to Fig. 1, the same numerals in all figures of the drawing relate to the same part functioning in the same manner as described.

The embodiment shown in FIG. 3 has a vertical plate-like portion and two arcuate generally vertical uprights 36 to form base 30. An embodiment similar to that shown in FIG. 3 may have a horizontal plate-like portion which solely supports arcuate generally vertical uprights without the vertical plate-like portion as shown. Arcuate uprights 36 have slots 35 which function to vertically position adjustment bar 31. The embodiment shown in FIG. 3 is particularly useful when it is desired to have lamp bar 10 at a near horizontal or at an angle below horizontal. The form of the base 30 shown in FIG. 3 is especially useful when it is desired to hook the lamp on a vertical plate-like structure such as a bed headboard or the top of a high back chair by placing the headboard or other structure between the vertical plate-like portion and the two arcuate uprights of the base.

Figure 4:
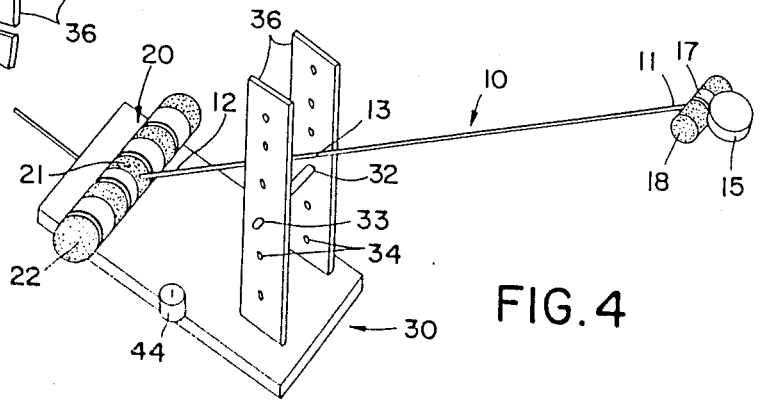
FIG. 4 is a perspective view of another embodiment of this invention having a lamp bar pivot fixedly attached to a flat base portion and generally vertically adjustable support mating with two uprights.

FIG. 4 shows an embodiment similar to that of FIG. 2 except that vertical uprights 36 are parallel flat plate structures aligned with lamp bar 10 passing about midway between them.

Figure 5:
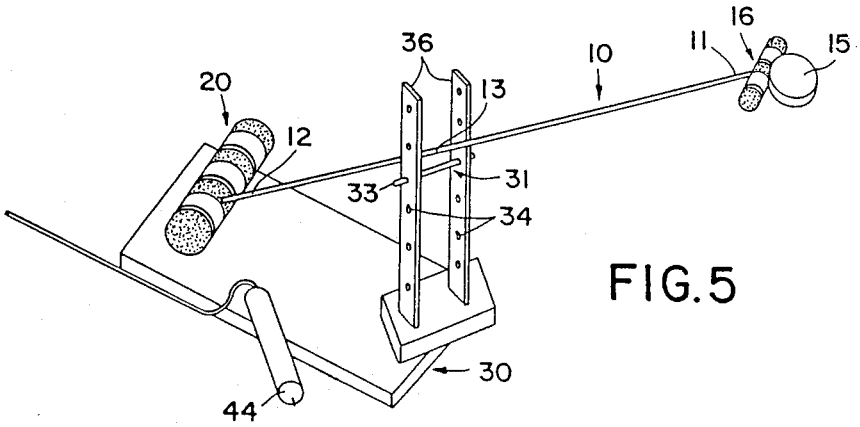
FIG. 5 is a perspective view of another embodiment of this invention similar to FIG. 4 except that the two uprights are not aligned with the lamp bar.

FIG. 5 shows another embodiment similar to the structure shown in FIG. 4 except lamp bar 10 is not aligned with vertical uprights 36 and passes between them at an angle.

Figure 6:
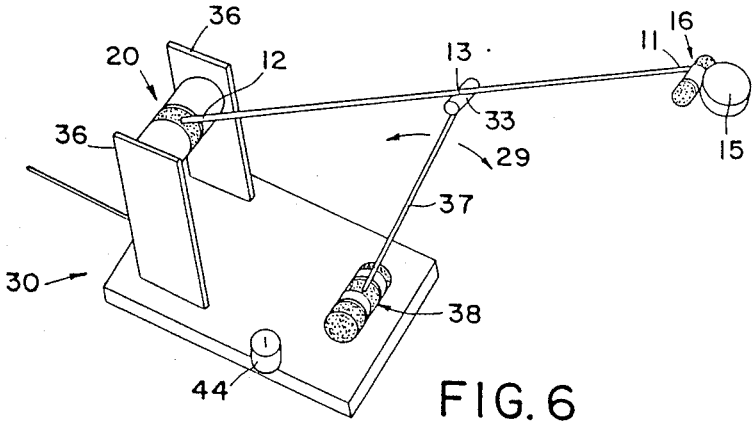
FIG. 6 is a perspective view of another embodiment of this invention having a lamp bar pivot fixedly attached to uprights extending from a flat base portion and an adjustable bar arm pivotally mounted by pivot means to the base at one end and the opposite end positioning the lamp bar by contact at the support point.

Another embodiment shown in FIG. 6 has base 30 comprised of a horizontal flat plate-like portion and vertical upright portions 36. In this embodiment, pivot end 12 of lamp bar 10 is pivotally attached to lamp bar pivot means 20 which is attached to upright portions 36 in a vertically non-adjustable manner. Support means comprise adjustment bar arm 37 which is attached to the horizontal flat portion of base 30 through pivot means 38 providing pivotal movement of adjustment bar arm 37 in the direction of arrows 29 to provide vertical adjustment of lamp bar 10 resting on positioning portion 33 at support point 13. It is readily apparent that adjustment bar arm 37 may extend above lamp arm 10 and positioning portion 33 may be a cross bar or any other extending structure upon which support point 13 may rest. It is recognized that with movement of adjustment bar arm 37 support point 13 will move along lamp bar 10.

Figure 7:
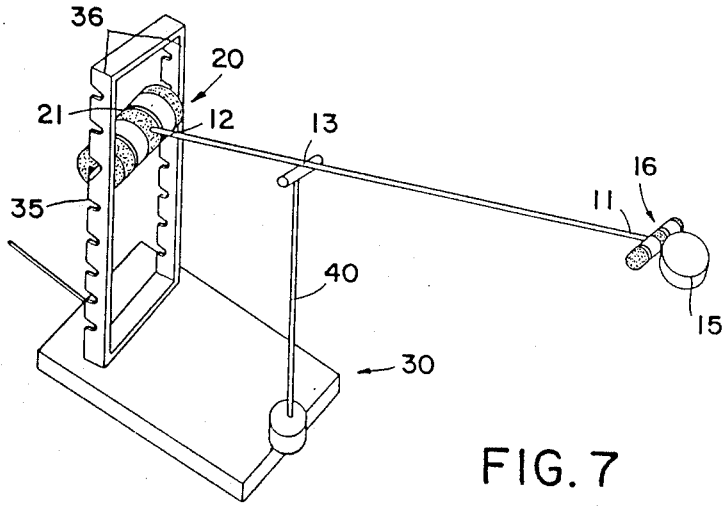
FIG. 7 is a perspective view of another embodiment of this invention having generally vertical adjustment of the pivot means at the pivot end of the lamp bar with a fixed support bar extending above the base and supporting the lamp bar at the support point.

FIG. 7 shows lamp bar pivot means 20 fixedly or pivotally attached to pivot end 12 of lamp arm 10 and vertically adjustable by placement in slots 35 of vertical uprights 36 of base 30. The end of pivot means 20 may be held in a fixed relation to upright portions 36 while an interior portion of pivot means 20 may pivot to provide movement of lamp arm 10. Electricity may be conducted by vertical uprights 36 to lamp arm 10 through pivot means 20 by various means known to the art, such as by a conducting pin passing through a hole in vertical upright 36 to complete electrical contact and to position pivot means 20. Pivotal action is obtained by rotary movement of pivot means 20 with respect to vertical uprights 36. Support means in this embodiment comprises fixed support bar 40 which is attached to base 30 at one end and provides support to support point 13 of lamp bar 10 to provide desired vertical height of lamp 15 by movement of pivot means 20 to corresponding slots 35.

Figure 8:
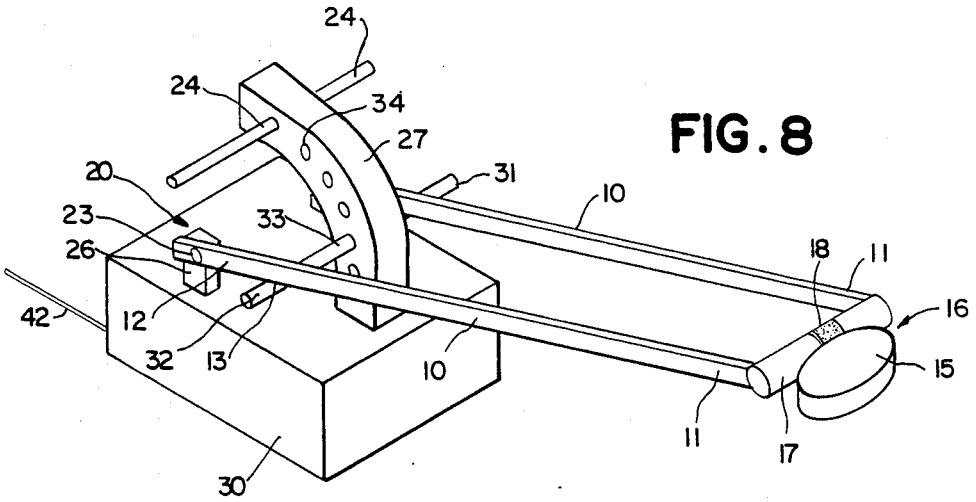
FIG. 8 is a perspective view of another embodiment of this invention having lamp bar pivots fixedly attached to upright pivot legs and a support leg fixedly attached to a base.

FIG. 8 shows another embodiment of an adjustable lamp according to this invention with one generally vertical support leg 27 fixedly attached to base 30. Lamp bars 10 each have lamp end 11 and pivot end 12 with support point 13 located therebetween. It is apparent that a plurality of lamp bars 10 can perform the same function as two lamp bars 10 as shown in FIG. 8. Likewise, a plurality of support legs 27 can perform the same function as one support leg 27 as shown in FIG. 8. Each lamp bar 10 may be constructed of any generally rigid material such as brass or steel metals, of a synthetic polymer material such as nylon or fiberglass, or any other suitable material known to the art. As shown in FIG. 8, lamp bars 10 preferably have a rectangular cross section but may also be of a tubular shape, a channel or any other shape which preferably provides concealed carrying of electrical wires or bus bars for its length to provide electricity to the lamp located at lamp end 11. Any suitable illuminating lamp 15 may be mounted on lamp end 11 of lamp bars 10. Illuminating lamp 15 may be of any suitable illuminating type known to the art, such as a high intensity lamp or the like.

Illuminating lamp 15 may be fixedly attached to lamp end 11 of lamp bars 10 or preferably is attached by lamp pivot and/or swivel means 16 which, as shown in FIG. 8, has a fixed portion 17 fixedly attached to lamp ends 11 and a pivot or swivel portion 18 for fixed attachment to illuminating lamp 15 by a wide variety of means well known to the art. It is apparent that the pivot and/or swivel movement of illuminating lamp 15 can be accomplished by changing fixed portion 17 to a pivot portion, by changing central pivot and/or swivel portion 18 to a swivel portion, by changing any combination of the above, or by any other suitable method known to the art.

As shown in FIG. 8, lamp bar pivot means 20 comprises two upright pivot legs 26 fixedly attached to base 30 in a vertically non-adjustable manner. It is apparent that pivot means 20 can also comprise any other suitable internal or external connection to base 30, such as a generally vertical and upright pivot leg 26 having adjusting means for varying the location of pivot 23, pivot 23 being recessed within base 30, or the like. Support means in this embodiment comprise adjustment bar 31 having support portions 32 for support of each lamp bar 10 at support point 13 and positioning portion 33 for vertical adjustment in support leg holding means, shown in FIG. 8 as holes 34. Adjustment bar 31 may be provided as any sufficiently rigid material such as metals, woods or synthetic polymers, and may be of any suitable shape to mate with a generally vertically arranged plurality of support leg holding means which may be in the form of notches 35 as shown in FIG. 3, holes 34 as shown in FIGS. 1 and 8, or any other type of generally vertically arranged holding means. In the case of losing or misplacing the supplied adjustment bar 31, adjustment bar 31 can even be a suitable pencil, pen or other writing instrument or another suitable elongated desk supply.

Illuminating lamp 15 may be vertically adjusted by placing adjustment bar 31 in any of the generally vertically arranged holes 34 of support leg 27, as shown in FIG. 8, which is fixedly attached to base 30. Illuminating lamp 15 may be pivoted to an out-of-the-way position simply by lifting lamp end 11 of lamp bar 10 thereby pivoting lamp bar pivot means 20 to a desired upright or laid-back position against stop bar 24 or another stop means known to the art acting upon pivot 23. Illuminating lamp 15 is then returned to its identical illuminating position by pivoting lamp bar 10 forward so that support point 13 of lamp bar 10 again rests upon adjustment bar 31. Electricity can be fed to illuminating lamp 15 through pivot 23 of lamp bar pivot means 20 and lamp bar 10 by means well known to the art.

FIG. 8 shows stop bar 24 located at the uppermost portion of support leg 27. Stop bar 24 may be permanently mounted to support leg 27 but is preferably interchangeably mounted within hole 34 of support leg 27. Stop bar 24 prevents lamp bar 10 from pivoting beyond the vertical position of lamp bar 10 when lamp bar 10 makes contact with stop bar 24.

Figure 9:
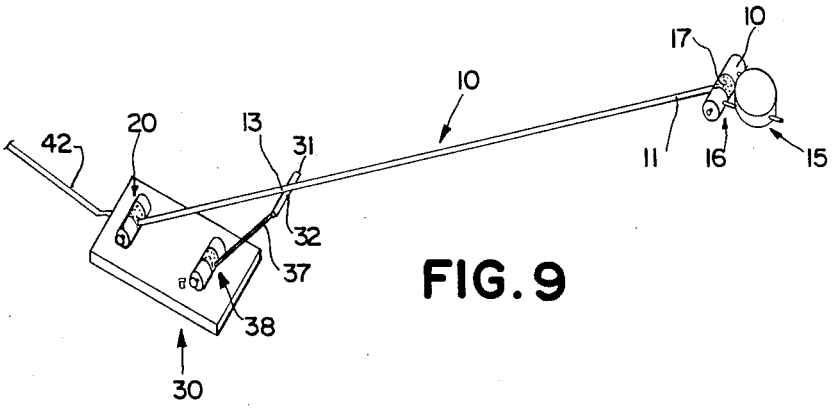
FIG. 9 is a perspective of another embodiment of this invention having a lamp bar pivot fixedly attached to the base and an adjustable bar arm pivotally attached to the base.
Figure 13:
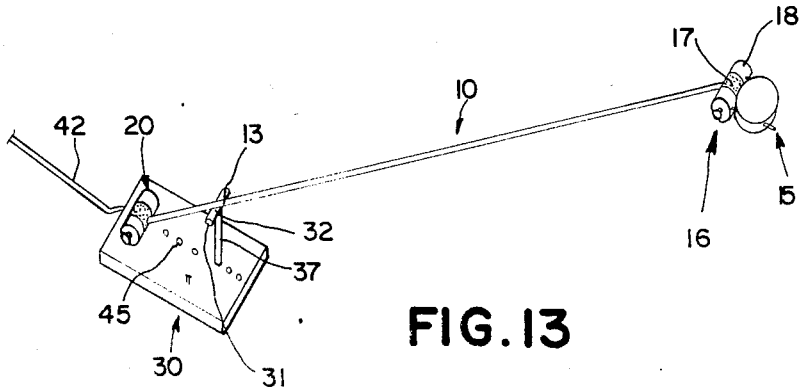
FIG. 13 is a perspective view of another embodiment of this invention having a lamp bar pivot fixedly attached to the base and an adjustment bar arm mateably engageable with holes in the base.

FIGS. 9–13 show another embodiment according to this invention of an adjustable lamp having features similar to those of the adjustable lamp described above and shown in FIG. 6. As shown in FIG. 9, pivot end 12 of lamp bar 10 is pivotally attached to lamp bar pivot means 20. In such embodiments, lamp bar pivot means 20 further comprise end fixed portions 22 fixedly attached to base 30 by means of assembly nut 26. By being fixedly attached to base 30, pivot means 20 cannot move in any direction with respect to base 30. Pivot means 20 only allows pivotal movement of lamp bar 10 with respect to base 30. Once lamp bar 10 is moved to a position having a desired vertical length component with respect to base 30 or the ground, such position can be fixed by rotating and tightening adjustment/assembly screw 25.

As shown in FIG. 9, support means comprise adjustment bar arm 37 having one end fixedly attached to adjustment bar pivot means 38 and the opposite end making contact with and supporting lamp bar 10 at support point 13. End fixed portions 22 of adjustment bar pivot means 38 is fixedly attached to base 30 by means of assembly nut 26 in a fashion similar to the attachment of lamp bar pivot means 20 to base 30. Electric supply cord 42 is routed through base 30, lamp bar pivot means 20 and lamp bar 10 as shown in Figs. 10–12. In a preferred embodiment of this invention, base 30 has at least three feet 27 mounted on the bottom of base 30 for raising the bottom of base 30 relative to the surface upon which base 30 rests. It is apparent that feet 27 can be vertically and/or horizontally adjustable. Feet 27 are preferably of a rubber or other suitable anti-skid material.

According to the embodiment shown in Fig. 9, the position of illuminating lamp 15 with respect to base 30 is adjusted by loosening adjustment/assembly screw 25 of lamp bar pivot means 20, rotating lamp bar 10 to a desired position, tightening adjustment/assembly screw 25 of lamp bar pivot means 20, loosening adjustment/assembly screw 25 of adjustment bar pivot means 38, rotating adjustment bar arm 37 until adjustment bar 31 makes supporting contact with lamp bar 10 at support point 13, and tightening adjustment/assembly screw 25 of adjustment bar pivot means 38.

Figures 14, 15, 16:
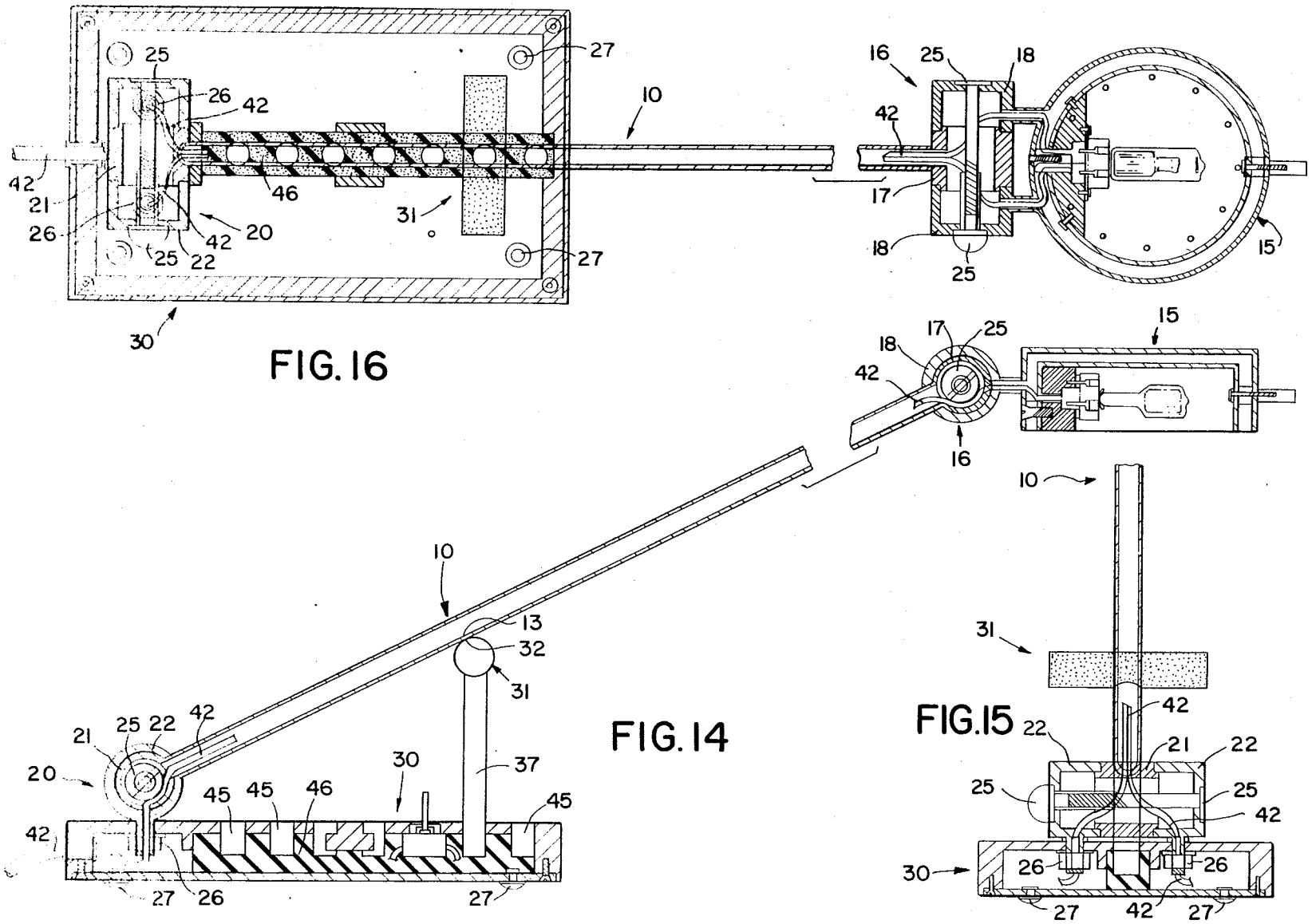
FIG. 14 shows a cross-sectional front view of an adjustable lamp as shown in FIG. 13.
FIG. 15 shows a cross-sectional side view of an adjustable lamp as shown in FIG. 14.
FIG. 16 shows a cross-sectional top view of an adjustable lamp as shown in FIG. 14.

FIGS. 13–16 show another embodiment according to this invention of an adjustable lamp having features similar to the embodiment shown in FIGS. 9–12 with the following distinctions. Base 30 has a plurality of adjustment holes 45 that are sized to mate with the end of adjustment bar 31 which is opposite adjustment bar support portion 32, as shown in FIG. 14. In this embodiment as shown in FIGS. 9–12, adjustment bar 31 is a free element that is engageable with an adjustment hole 45 of base 30 but also can be removed or separated from base 30 and any other member of this invention. Adjustment holes 45 are preferably aligned along base 30 so that as adjustment bar 31 is moved in holes closer to lamp bar pivot means 20, the vertical height of illuminating lamp 15 increases. In a preferred embodiment of this invention, adjustment hole insert 46 is mounted within base 30 to facilitate a tight and secure fit of adjustment bar arm 37 in adjustment hole 45. Adjustment hole insert 46 is preferably made of rubber or other suitable material which has frictional properties for ensuring a tight fit between adjustment bar arm 37 and adjustment hole 45.

In another preferred embodiment according to the invention as shown in FIGS. 13–16, base 30 has at least one adjustment hole 45 and adjustment bar arm 37 has a telescoping arm, interlocking sections or other suitable mechanical configurations for adjusting the vertical length of adjustment bar arm 37. In such embodiment, adjustment bar arm 37 can remain fixed with respect to base 30 while maintaining the ability to adjust the height of illuminating lamp 15 by changing the vertical height of adjustment bar 37.

The above description includes many preferred embodiments of an adjustable lamp as shown in FIGS. 1–16. It is apparent that the many features of each embodiment of this invention can be interchanged without detracting from the general principles of this invention.

It is seen from the description of specific embodiments that an adjustable lamp of this invention has a lamp bar with a lamp end and an opposite pivot end with a support point therebetween. A lamp bar pivot means is attached to the pivot end of the lamp bar and to a base in a manner to provide generally vertical pivotal movement of the lamp bar. The pivot means may be vertically fixedly attached to the base or may be vertically adjustably attached to the base. Support means are attached to the base to support the lamp bar at the support point to provide desired lamp vertical positioning. The support means may be vertically fixedly attached to the base or may be vertically adjustably attached to the base, provided that at least one of the lamp bar pivot means and the support means is vertically adjustably attached to the base. Both the lamp bar pivot means and the support means may be vertically adjustably attached to the base. It is readily apparent that a wide variety of specific structures may be used to construct the components of the adjustable lamp of this invention as long as the above described relations of the components are observed.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An adjustable lamp comprising: a base, a top wall of said base having at least one adjustment hole;

at least one lamp bar, each said lamp bar having a lamp end, an opposite pivot end and a support point therebetween, pivot means secured to said base, said opposite pivot end secured to said pivot means;

lighting means secured to said lamp end;

an adjustment bar arm having an adjustment hole end matingly engageable with said at least one adjustment hole, an adjustment bar attached to an adjustment bar end which is opposite said adjustment hole end of said adjustment bar arm, said adjustment bar having a support portion in point contact with said at least one lamp bar at said support point to provide a desired lamp vertical position; and said pivot means comprising at least one central pivot portion pivotally supported between at least two end fixed portions, each said end fixed portion secured to said base, said opposite pivot end of said at least one lamp bar secured to said central pivot portion, said central pivot portion rotatable with respect to said at least two end fixed portions, an adjustment/assembly screw supported between said at least two end fixed portions, and said central pivot portion lockable with respect to said end fixed portion by tightening said adjustment/assembly screw.

2. An adjustable lamp according to Claim 1 further comprising an elongated adjustment hole insert fixed within said base, said elongated adjustment hole insert approximately aligned with a longitudinal axis of said lamp bar, and said adjustment holes extending into said elongated adjustment hole insert.

3. An adjustable lamp according to Claim 2 wherein said elongated adjustment hole insert further comprises a rubber material.

4. An adjustable lamp according to Claim 1 further comprising one said lamp bar, one said central pivot portion and two said end fixed portions.

5. An adjustable lamp according to Claim 1 further comprising one said adjustment hole and said adjustment bar arm further comprises extension means for extending the vertical length of said adjustment bar arm.

6. In an adjustable lamp of the type having a base, at least one lamp bar, each said lamp bar having one end pivotally attached to said base at pivot means and lighting means secured to an opposite end of said lamp bar, the improvement comprising: said base having at least one adjustment hole, an adjustment bar arm having an adjustment hole end matingly engageable with said at least one adjustment hole, an adjustment bar attached to an adjustment bar end which is opposite said adjustment hole end of said adjustment bar arm, said adjustment bar having a support portion in point contact with said at least one lamp bar to provide a desired lamp vertical position; and said pivot means comprising at least one central pivot portion pivotally supported between at least two end fixed portions, each said end fixed portion secured to said base, said opposite pivot end of said at least one lamp bar secured to said central pivot portion, said central pivot portion rotatable with respect to said at least two end fixed portions, an adjustment/assembly screw supported between said at least two end fixed portions, and said central pivot portion lockable with respect to said end fixed portion by tightening said adjustment/assembly screw.

* * * * *